US005873806A

United States Patent [19]

Biagiotti

[11] Patent Number: 5,873,806

[45] Date of Patent: Feb. 23, 1999

[54] MACHINE FOR PRODUCING CARDBOARD OR SIMILAR TUBES, WITH MEANS FOR CUTTING THE TUBE INTO SECTIONS OF PREDETERMINED LENGTHS

[75] Inventor: Guglielmo Biagiotti, Lucca, Italy

[73] Assignee: Fabio Perini, S.p.A., Lucca, Italy

[21] Appl. No.: 959,708

[22] Filed: Oct. 28, 1997

Related U.S. Application Data

[63] Continuation of Ser. No. 433,329, May 5, 1995, abandoned.

[30] Foreign Application Priority Data

Oct. 8, 1993 [IT] Italy ..... FI93A0198

[51] Int. Cl.[6] ..... B31C 11/02

[52] U.S. Cl. ..... 493/290; 493/299; 493/288; 83/54; 83/318; 83/320

[58] Field of Search ..... 493/287–290, 493/299; 83/54, 318–320

[56] References Cited

U.S. PATENT DOCUMENTS

| | | | |
|---|---|---|---|
| 1,519,754 | 12/1924 | Butler | 493/288 |
| 1,567,289 | 12/1925 | Munroe | 83/319 |
| 2,133,542 | 10/1938 | Jensen | 83/319 |
| 2,502,638 | 4/1950 | Becht | 493/288 |
| 2,534,360 | 12/1950 | Loverch | 83/320 |
| 2,623,445 | 12/1952 | Robinson | 493/287 |
| 2,699,099 | 1/1955 | Robinson | 493/288 |
| 2,812,007 | 11/1957 | Touchett et al. | 493/288 |
| 3,150,575 | 9/1964 | Couzens et al. | 493/288 |
| 3,190,162 | 6/1965 | Sonneland | 83/319 |
| 3,220,320 | 11/1965 | Brigham | 493/288 |
| 3,636,827 | 1/1972 | Lindberg | 493/288 |
| 3,759,127 | 9/1973 | Mills | 83/318 |
| 3,942,418 | 3/1976 | Smith | 493/299 |
| 3,977,309 | 8/1976 | Gilbert | 493/287 |
| 3,991,663 | 11/1976 | Glasby | 493/287 |
| 4,378,966 | 4/1983 | Schumacher | 493/290 |
| 4,444,077 | 4/1984 | Wise et al. | 83/319 |
| 4,521,264 | 6/1985 | Mueller | 493/288 |
| 4,756,217 | 7/1988 | Holmes | 493/289 |
| 4,934,227 | 6/1990 | Knorr | 493/287 |
| 5,014,579 | 5/1991 | Galonska | 493/288 |
| 5,016,507 | 5/1991 | Riera et al. | 83/319 |
| 5,088,365 | 2/1992 | Nolan | 83/319 |
| 5,468,207 | 11/1995 | Bower et al. | 493/288 |

FOREIGN PATENT DOCUMENTS 2262578 9/1975 France .

*Primary Examiner*—Michael J. Carone
*Assistant Examiner*—Darren Ark
*Attorney, Agent, or Firm*—Breiner & Breiner

[57] ABSTRACT

A machine for producing tubes by winding into a spiral two or more overlapping and staggered strips of a ribbon-shaped material on a spindle, having a winding unit which winds into a spiral two or more overlapping and staggered strips of a ribbon-shaped material on the spindle and causes the tube formed from the material to advance continuously, and a cutting unit fitted with rotating tube cutters and provided with a reciprocating motion along the direction of advance of the tube to cut the tube into sections of predetermined length during the advance of the tube. The cutting unit is associated with members for driving the rotating cutters, which impart to the rotating cutters a rotary motion derived from the reciprocating motion of the cutting unit.

11 Claims, 4 Drawing Sheets

MACHINE FOR PRODUCING CARDBOARD OR SIMILAR TUBES, WITH MEANS FOR CUTTING THE TUBE INTO SECTIONS OF PREDETERMINED LENGTHS

This is a continuation of application Ser. No. 08/433,329 filed on May 5, 1995 now abandoned.

TECHNICAL FIELD

The invention relates to a machine for producing tubes by winding into a spiral two or more overlapping and staggered strips of a ribbon-shaped material on a spindle, comprising: a winding unit which continuously winds into a spiral the strips of ribbon-shaped material on a spindle and causes the tube formed from the said material to advance continuously; and a cutting unit fitted with rotating tube-cutting means and provided with a reciprocating traversing motion along the direction of advance of the tube, to cut the said tube into sections of predetermined length during the advance of the tube.

These machines are normally used in the paper processing industry to produce tubes or what are known as tubular cores of cardboard or similar, on which a layer of paper is subsequently wound to produce rolls. Similar applications are found in other sectors where it is necessary to wind a ribbon-shaped material on a tubular core to produce rolls, for example in the production of plastic film for industrial or domestic use, materials based on metallized film for packaging, and the like. Similar tubes are also used to produce containers for solid or liquid products, particularly in the food industry.

BACKGROUND ART

A machine of the type described initially is described, for example, in Italian Patent No. 1,204,029, only in respect of the unit for cutting the tube at the exit from the machine. In this known machine, the cutting members consist of circular cutters of low mass which, when the tube is to be cut, are brought up to the tube which advances and rotates about its own axis, and are put into axial and rotating movement by the contact with the tube itself. The circular cutters are in other words fitted so that they are free-running and idle on the corresponding supporting arms.

To obtain a more effective cut, particularly when the thickness of the tube is large, in certain cases electric motors associated with two circular cutters are used, these motors imparting the cutting motion to the cutters when they are required to cut the tube. This solution entails high costs and increases the masses present. Since the cutting unit on which the rotating cutting members are fitted has to move with a reciprocating motion along the direction of advance of the continuously produced tube, it is desirable to reduce to a minimum the masses present and consequently the inertial forces arising from the reciprocating traversing motion of the cutting unit.

The object of the present invention is to provide a machine of the type described initially, in which the cutting members are given a cutting motion for more effective cutting of the tube, with a simple, compact structure of limited mass to reduce the inertial forces present and also the costs of maintenance and production of the machine.

DISCLOSURE OF THE INVENTION

These and other objects and advantages, which will be clearly apparent to those skilled in the art from a reading of the following text, are obtained with a machine of the type described initially, characterized in that the cutting unit is associated with members for driving the rotating cutting means, which impart to the said rotating cutting means a rotary motion derived from the reciprocal traversing motion of the cutting unit. It is therefore unnecessary to provide the cutting members with independent actuators, which represent an additional cost and weight and which may be the source of problems from the point of view of maintenance.

In a practical embodiment, in order to derive a rotary motion of the cutting means from the reciprocating traversing motion of the cutting unit, a belt or similar flexible member, fastened at two fixed points to the structure of the machine, is provided. The fastening points are located beyond the travel of the cutting unit, one before and one after the said travel with respect to the direction of advance of the tube. The portion of flexible member lying between the two points of fastening to the fixed structure is run around a pulley carried by the cutting unit. The pulley is kinematically connected to the rotating cutting means. In this way, when the cutting unit is moved with a reciprocating traversing motion to perform the cut, advancing at the same speed as the tube being formed and returning to the starting position at the end of each cut, the flexible member causes the rotation, by the effect of the motion of the cutting unit, of the pulley which in turn transmits its own rotary motion to the cutting members.

The flexible member may be an open flexible member fastened at its ends to the structure of the machine, but it is also possible for it to consist of a closed belt, of which only one section, delimited by the two points fastened to the fixed structure, is used.

Further advantageous characteristics and embodiments of the machine according to the invention are indicated in the attached dependent claims.

The reciprocating traversing motion of the cutting unit may be derived by a kinematic connection directly from the actuator which drives the systems of winding the ribbon-shaped material and of advancing the tube thus formed. However, in a particularly advantageous embodiment, the cutting unit is driven by its own independent actuator controlled by a central unit which also controls the actuator responsible for the feed of the ribbon-shaped material, for its winding into a spiral and for the advance of the tube being formed. This makes it possible to optimize the motion of the cutting unit with respect to the movement of advance of the tube during the cutting operations, as will be described in greater detail in the following text.

BRIEF DESCRIPTION OF THE DRAWINGS

The invention will be more readily understood from the description and the attached drawing, which shows a non-restrictive practical embodiment of the invention. In the drawing.

Best Mode for Carrying out the Invention

Figure 1:
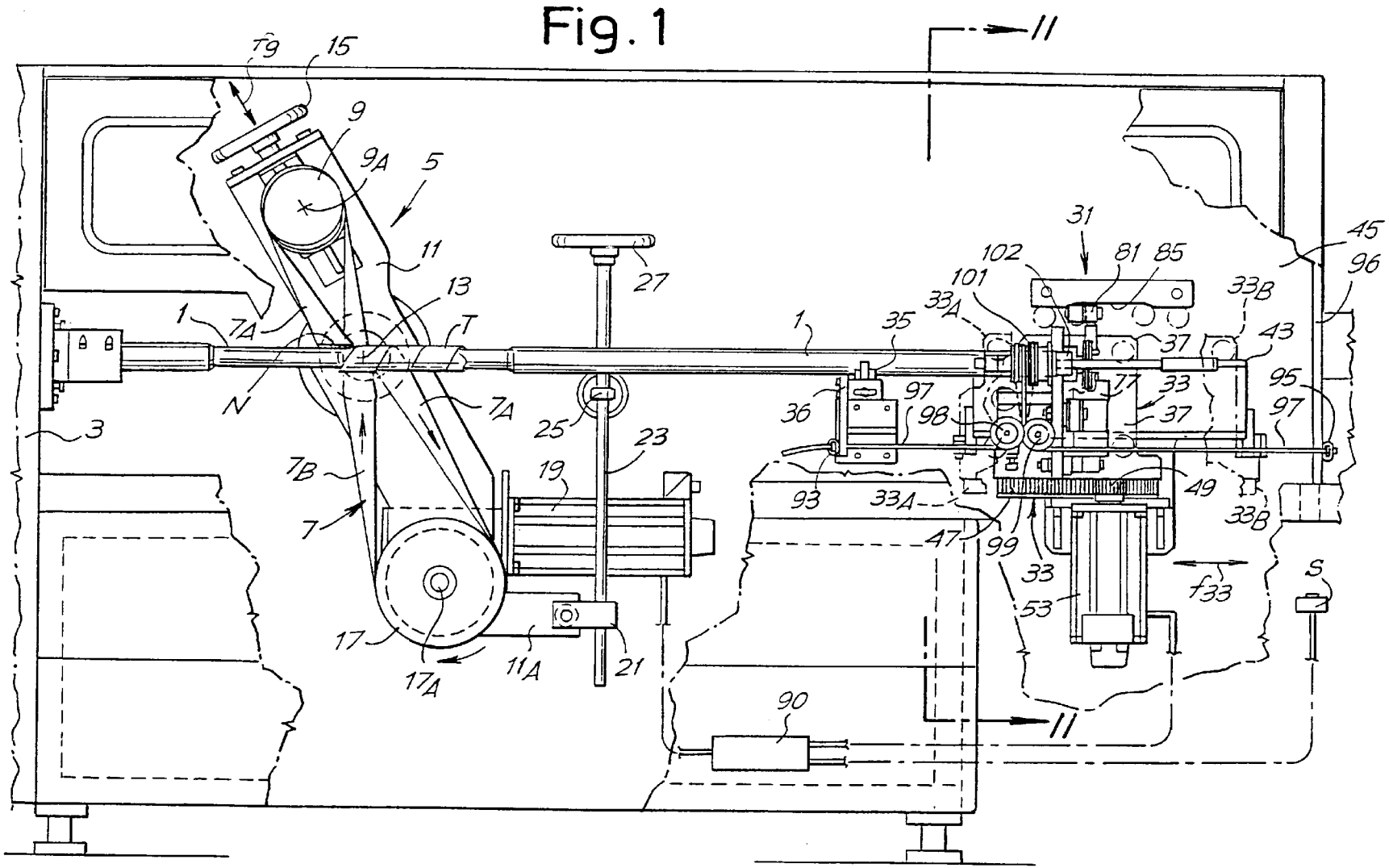
FIG. 1 is a side view of the machine.
Figure 2:
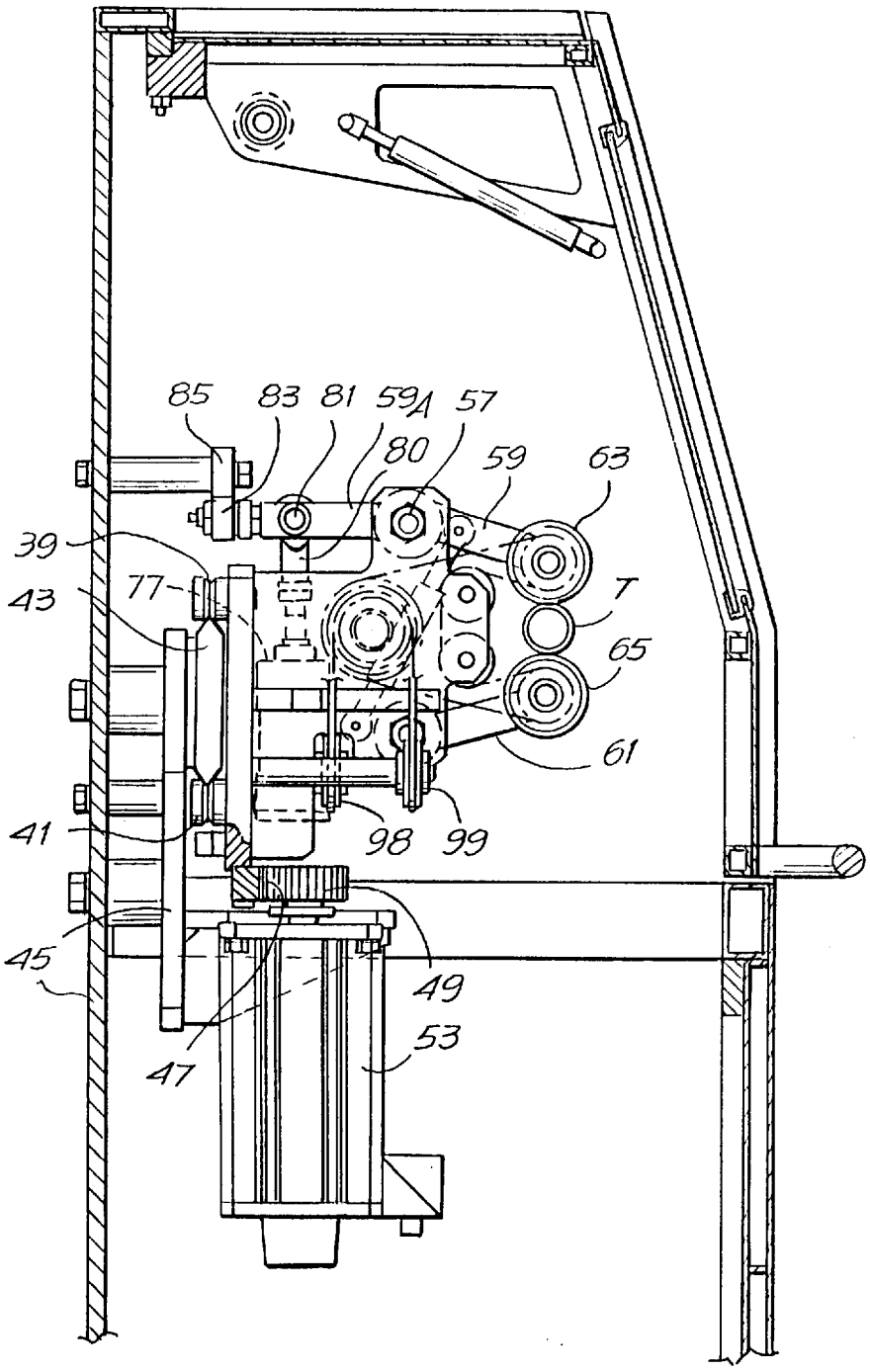
FIG. 2 is a section through II—II in FIG. 1.

With reference initially to FIGS. 1 and 2, the machine comprises a winding spindle or mandrel 1, fitted to and projecting from the column 3 of the machine. The spindle 1 may be fixed or fitted free-running so that it can rotate during the production of the tube. The number 5 indicates in a general way the winding unit which winds the ribbon-shaped material into a spiral on the spindle 1 to form the tube. This tube, during the continuous formation, is constantly rotated and advanced along its own axis and consequently along the spindle 1. The ribbon-shaped material, in the form of at least two staggered strips, is fed in a direction substantially perpendicular to the plane of FIG. 1, and in the figure the transverse section N of the material may be seen.

The winding unit comprises a belt 7 running around a roller 9 with an axis 9A slightly inclined with respect to the horizontal. The roller 9 is carried by a moving element 11 hinged, about an axis 13, to the structure of the machine. The position of the roller 9 may be adjusted in the direction F9 by a handwheel 15 to adjust the tension of the belt 7. The belt takes its motion from a pulley 17 with a substantially horizontal axis 17A, rotated by an actuator 19 in the form of a brushless or other motor. The motor 19 is carried directly by the moving element 11. This element has in its lower part an appendage 11A integral with a threaded bush 21, in which is engaged a threaded bar 23 supported at 25 by the structure of the machine and fitted with a handwheel 27. By means of the handwheel 27 and the threaded bar 23 it is possible to adjust the inclination of the moving element 11 about its own axis 13, in order to vary the angle of winding of the ribbon-shaped material N on the spindle 1. The number 7B indicates the ascending section of the belt 7.

The belt 7 has a first section 7A which is wound with one turn around the spindle 1. The inclination of the turn formed by the section 7A depends on the inclination of the moving element 11. The ribbon-shaped material N is inserted between the spindle 1 and the section 7A of the belt at the point of the turn which the belt forms around the spindle, so that the rotation of the pulley 17 and the pull of the belt 7 cause the traction and winding of the ribbon-shaped material on the spindle.

A second strip of material, with its lower surface provided with glue, is wound on the first, and staggered by approximately half its width.

In this way the tube is formed and advances along the spindle as it is formed. It is possible to have formation with more than two strips in the same way, other strips being laid down each with its lower surface provided with glue.

The spindle 1 extends to a cutting station 31 which comprises a cutting unit 33 movable with reciprocating motion as shown by the double arrow f33. In an intermediate position, the spindle 1 is supported by rollers 35 fitted on an assembly 36 and forming a subdividing member for the support of the spindle 1.

Figure 3:
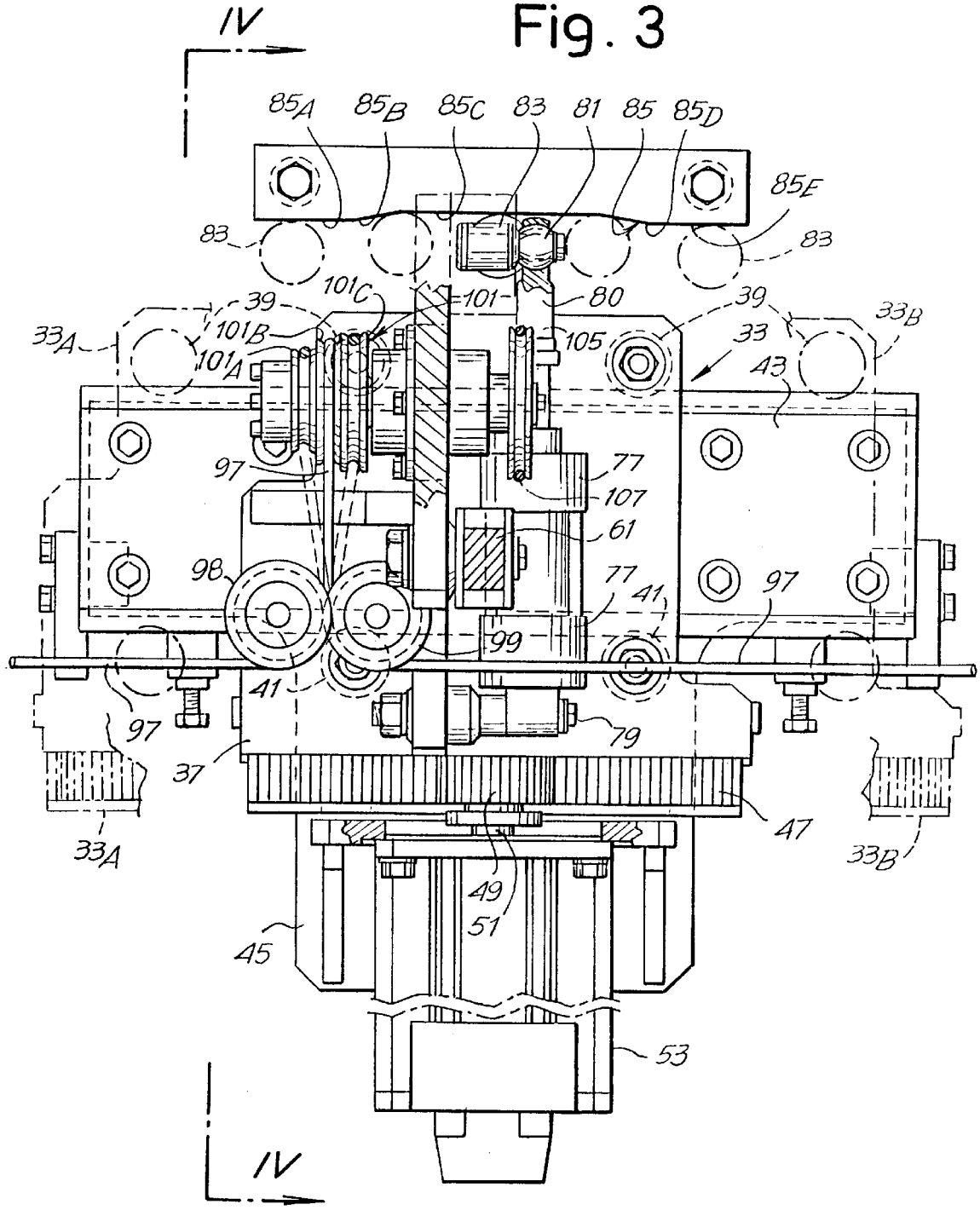
FIG. 3 is an enlarged side view, with parts removed, of the cutting unit through III—III in FIG. 4.
Figure 4:
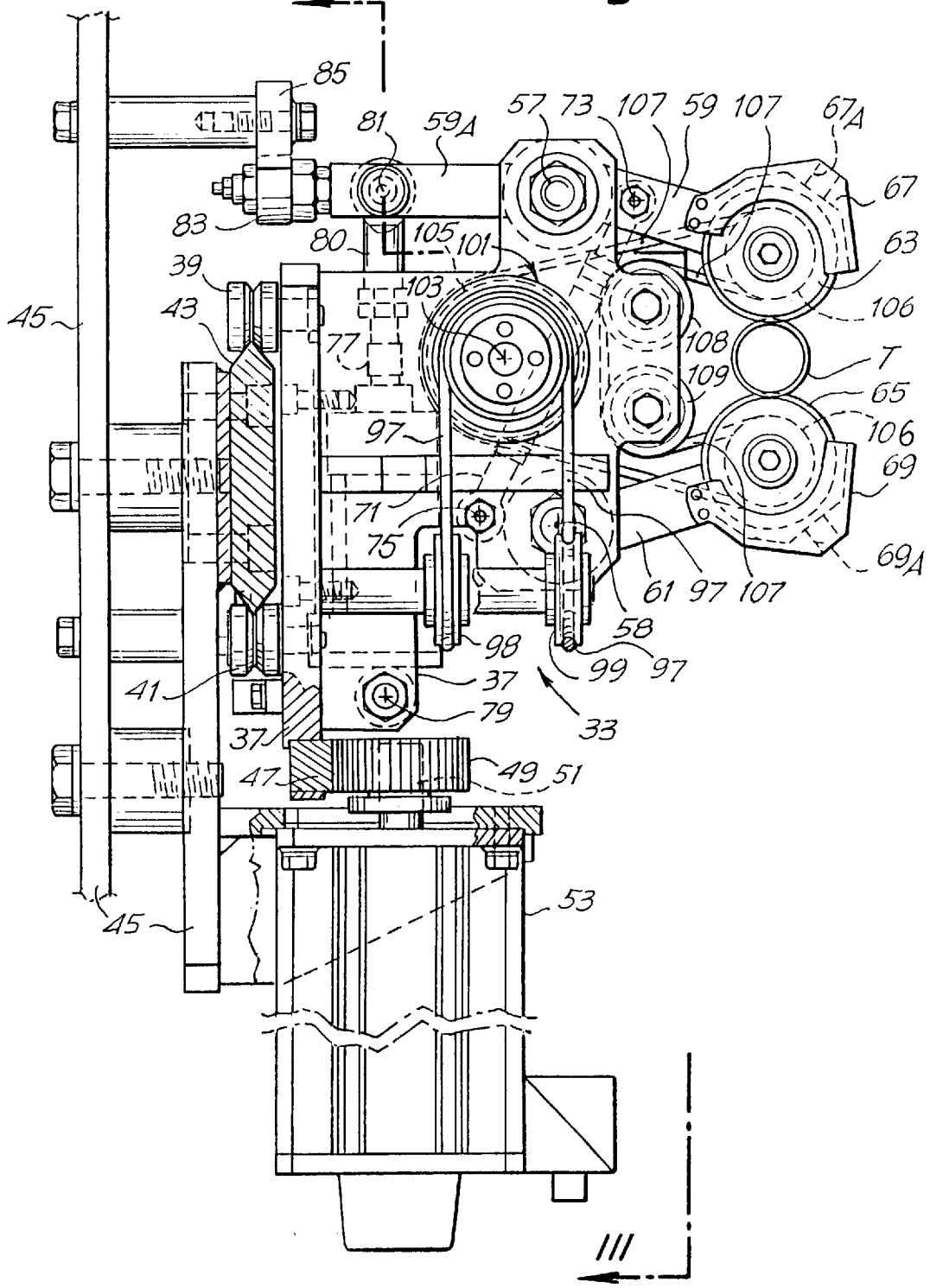
FIG. 4 is a rear view through IV—IV in FIG. 3 and a partial section.

The cutting unit 33 is illustrated in detail in FIGS. 3 and 4. It has a carriage 37 free to run on guide rollers 39, 41 with a V-shaped groove, on a double guide 43 integral with the structure 45 of the machine. The carriage 37 is integral with a rack 47 engaging with a pinion 49 keyed to the output shaft 51 of an actuator 53. This actuator consists, in the example illustrated, of an electric motor of the brushless type, but may also be a geared motor.

The actuator 53, supported by the fixed structure 45 of the machine, can rotate in one direction and in the other to impart the reciprocating motion to the cutting unit 33 for the purposes described below.

On the cutting unit 33 there are pivoted at 57 and 58 two oscillating arms 59 and 61 respectively, which each carry at their ends cutting means in the form of rotating circular cutters 63 and 65. The numbers 67 and 69 indicate two guards of the rotating cutters, pierced at 67A and 69A respectively, for the insertion of a lubricating felt.

The oscillating arms 59 and 61 are connected together by a link or rod 71 hinged at 73 and 75 to the arms 59 and 61 respectively. In this way the arms 59 and 61 are kinematically interconnected so that they are made to oscillate simultaneously by a single cylinder and piston actuator 77, whose cylinder is connected at 79 to the carriage 37, while the rod 80 is hinged at 81 to an extension 59A of the oscillating arm 59.

The extension 59A of the oscillating arm 59 is associated with a follower 83 interacting with a cam profile 85 integral with the structure 45 of the machine. The cam profile 85 has a first rectilinear portion 85A, parallel to the direction of advance of the tube T and therefore to the axis of the spindle 1; a second ramp portion 85B which connects the portion 85A to a third rectilinear portion 85C parallel to the portion 85A; and a fourth ramp portion 85D which connects the portion 85D to a final rectilinear portion 85E parallel to the portions 85A and 85C. The portions 85A and 85E are substantially in the same plane.

The operation of the cutting unit described up to this point is as follows.

While the winding unit 5 winds the ribbon-shaped material N into a spiral and advances the tube T being formed, the cutting unit 33 is in its waiting position (shown in broken lines in FIG. 1 and indicated by 33A therein), in which the said unit 33 is at the left-hand end (as seen in FIG. 1) of its travel. In this position, the follower 83 is under the portion 85a of the cam profile 85. When the cutting unit 33 is in the waiting position, the actuator 77 is kept in a position such that the cutters 63 and 65 are kept separated and therefore not in contact with the tube T, and the follower 83 is removed from the profile 85A.

At the discharge end of the machine (not illustrated) there is a sensor of the optical or similar type, with an adjustable position, which detects the arrival of the initial end of the tube being formed. In FIG. 1, the sensor is schematically indicated by S, but is shown only for information and not in its actual position. The detection of the arrival of the tube causes the sensor to emit a signal which makes the rod 80 emerge from the actuator 77 and starts the actuator 53. The latter moves from zero speed to an operating speed selected and controlled in such a way that, by means of the rack and pinion coupling 49 and 47, the cutting unit 33 is given a speed of advance equal to the speed of advance of the tube being formed, determined in the final analysis by the speed of rotation of the motor 19. A central control unit, indicated schematically by 90 in FIG. 1, controls the actuators 19 and 53, as well as the sensor S, in such a way that the speed of advance of the tube and that of the unit 33 are synchronized in the way described above.

Simultaneously with the starting of the actuator 53, the cylinder and piston actuator 77 is also activated, and causes the extension 59*a* of the arm 59 to oscillate in a clockwise direction, causing an oscillation of the arms 59 and 61 towards each other with consequent approach of the cutters 63 and 65. This oscillation is opposed by the presence of the follower 83 which initially bears on the portion 85A of the cam profile 85. When the cutting unit 33 starts to advance from left to right (FIG. 1), the follower 83 runs along the profile 85 and moves from the portion 85A to the portion 85B and then to the portion 85C which is in a higher position. During this movement, since the cylinder and piston actuator 77 is under pressure, the follower 83 is kept in contact with the cam profile 85 and the shape of the latter cause the oscillation of the arms 59 and 61 with the consequent relative approach of the cutters 63 and 65. The position of the portion 85C of the cam profile 85 is such that, when the follower 83 is on this portion 85C, the cutters 63 and 65 are pressed against the advancing tube. The lengths of the portions 85A, 85B of the cam profile 85 are selected in such a way that the follower 83 arrives at the portion 85C only when the cutting unit 33 has reached forward traversing speed substantially equal to the speed of advance of the tube T which is to be cut. In this way, the cutters 63 and 65 make a perfect cut of the tube T.

The length of the portion 85C of the cam profile 85 is such that it permits a complete cut of the tube T, and does not have to be changed with a variation of the diameter of the tube produced by the machine. Adaptation to the various diameters of the tube being formed may be carried out by modifying the position of the follower 83 which, for this purpose, has an eccentric axis. The position of the cutters is also adjustable by lengthening or shortening the rod 71.

When the tube has been cut, the cutting unit 33 is decelerated and stopped over a section of the travel during which the follower 83 runs on the portions 85D and 85E of the cam profile 85. In this advance overtravel, the cylinder and piston system 77 causes an oscillation in the opposite direction of the arms 59, 61, with consequent withdrawal of the cutters 63 and 65 from the tube T. When the position of maximum advance (indicated in broken lines by 33B in FIG. 1) has been reached, as detected by a position sensor which is not shown, the cutting unit 33 is accelerated in the opposite direction by a reversal of the rotation of the motor 53, and is returned to its waiting position. In the return travel, the follower 83 does not interact with the cam profile 85, since it is withdrawn by the cylinder and piston 77, and the cutters 63, 65 are kept separate from the tube T which continues to advance at its own production speed.

The circular cutters 63, 65 are provided with a cutting motion obtained by a conversion of the linear motion of the cutting unit 33 by the method described below.

A flexible member 97 (see FIG. 1) is fastened, at two points 93 and 95, to the fixed structure of the machine. In the example illustrated, the fastening point 93 is disposed on the unit 36, while the fastening point 95 is on a column 96. The fastening points 93, 95 of the flexible member 97 are located, respectively, before and after the travel of the cutting unit 33 with respect to the direction of advance of the tube T being formed. The flexible member 97 is run, as seen in particular in FIGS. 3 and 4, around two free-running return wheels 98 and 99 carried by the cutting unit 33. The wheels 98 and 99 have axes substantially parallel to each other and perpendicular to the direction of advance of the tube T, and consequently to the axis of the spindle 1. Between the two wheels 98 and 99, which are staggered with respect to each other as seen in FIG. 4, the flexible member 97 forms a loop which is run around a multiple pulley 101 with an axis parallel to the axis of the spindle 1.

In the example illustrated, the multiple pulley 101 has three grooves 101A, 101B and 101C of progressively increasing diameter, usable as alternatives. In FIG. 3 the flexible member 97 is run in the groove 101B of intermediate diameter. The use of a multiple pulley with grooves of different diameters permits, as will be made clear below, a variation of the speed of rotation of the cutters 63 and 65 with the same speed of advance of the tube T and of the cutting unit 33. The speed of rotation of the cutters is selected in such a way that their peripheral speed is equal to or greater than the peripheral speed of the tube T.

During cutting, the cutters interact with an opposing bush inside the tube T, indicated by 102 in FIG. 1, whose operation is described in the cited Italian Patent No. 1,204,029.

The multiple pulley 101 is fitted on a shaft 103 on which is also keyed a pulley 105 over which is run a belt 107 which takes the motion from the pulley 105 and transmits it to the circular cutters 63 and 65. The belt 107 is run for this purpose not only around the pulley 105 but also around two pulleys 106, belt 107 integral and coaxial with the cutters 63, 65 and around free-running guide pulleys 108 and 109 carried by the unit 33.

With the disposition illustrated above, when the cutting unit 33 moves as shown by the arrow f33 under the action of the motor 53, the flexible member 97 (a plain open belt of circular section in the example illustrated), being fastened at two fixed points to the structure of the machine, causes a rotation of the multiple pulley 101 and consequently a rotation of the pulley 105 and therefore of the circular cutters 63 and 65. Clearly, the direction of rotation of the circular cutters depends on the direction of advance of the cutting unit 33 and the said cutters reverse their rotation when the cutting unit 33, having reached the final position of its travel, moves back again. The rotation of the circular cutters during the return travel of the cutting unit 33 has no effect, since the said cutters have previously been withdrawn from the tube T by the method described above.

It is to be understood that the drawing shows only an example provided solely as a practical demonstration of the invention, and that this invention may be varied in its forms and dispositions without departure from the scope of the guiding concept of the invention. The presence of any reference numbers in the enclosed claims has the purpose of facilitating the reading of the claims with reference to the description and to the drawing, and does not limit the scope of protection represented by the claims.

I claim:

1. A machine for producing tubes by winding into a spiral a ribbon-shaped material on a spindle comprising:

a winding unit which winds into a spiral two or more overlapping and staggered strips of ribbon-shaped material on said spindle and causes a tube formed from said material to rotate around an axis of said spindle and to advance continuously along said spindle;

a cutting unit including a rotatable cutting means constructed and arranged to be perpendicular to a direction of advance of the tube, and a reciprocation means which moves said cutting unit in a reciprocating motion along the direction of advance of the tube on the spindle such that during cutting of the tube, an advancing speed of said cutting means is the same as an advancing speed of said tube;

wherein said reciprocation means imparts rotary motion to said cutting means, said rotary motion being derived from said reciprocating motion of said reciprocation means such that during cutting said cutting means rotates in a direction corresponding to a direction of rotation of said tube and at a speed proportional to a speed of rotation of the tube to be cut; and further wherein said spindle extends inside said tube up to the cutting means so that the spindle cooperates with the cutting means to provide a pressure cut of the tube.

2. The machine according to claim 1 wherein said reciprocation includes a flexible member fastened at a first fixed point and a second fixed point on the machine disposed beyond a range of travel of said cutting unit, the first fixed point being at a point before said range of travel of said cutting unit and said second fixed point being at a point after said range of travel of said cutting unit with respect to the direction of advance of the tube, said flexible member being run around a pulley carried by said cutting unit, and said pulley being kinematically connected to the cutting means.

3. The machine according to claim 2 wherein said flexible member is run around two free-running guide wheels carried on said cutting unit, disposed with axes of rotation approximately perpendicular to the reciprocating motion along the direction of advance of the tube, the flexible member forming a loop between said guide wheels which is run around said pulley having an axle disposed substantially parallel to the direction of motion of said cutting unit.

4. The machine according to claims 2 or 3 wherein said pulley is a multiple pulley comprising a plurality of grooves of different diameters.

5. The machine according to claims 2 or 3 wherein said flexible member is a plain belt of approximately circular section.

6. The machine according to claims 2 or 3 wherein said pulley around which the flexible member is run is fixed in rotation to a further auxiliary pulley around which is run a belt which transmits the rotary motion to said cutting means.

7. The machine according to claim 1 wherein said cutting means comprises two circular blades fitted on two oscillating arms movable between a first active position in which said cutting means is in contact with the tube to cut the tube, and a second inactive position in which said cutting means is disengaged from the tube.

8. The machine according to claim 7 wherein said two oscillating arms are kinematically interconnected and a single actuator causes oscillation of said two oscillating arms.

9. The machine according to claim 1 wherein said cutting unit is driven by an independent actuator which provides the reciprocating motion.

10. The machine according to claim 9 wherein said actuator is fixed with respect to the machine.

11.The machine according to claim 10 wherein the reciprocation means comprises a rack and pinion system.

* * * * *